United States Patent [19]

Nicol

[11] Patent Number: 5,027,776

[45] Date of Patent: Jul. 2, 1991

[54] FUEL PUMPING APPARATUS

[75] Inventor: Stuart W. Nicol, London, England

[73] Assignee: Lucas Industries Public Limited Company, Birmingham, England

[21] Appl. No.: 561,116

[22] Filed: Aug. 1, 1990

[30] Foreign Application Priority Data

Aug. 12, 1989 [GB] United Kingdom ..... 8918429

[51] Int. Cl.[5] ..... F02M 41/00

[52] U.S. Cl. ..... 123/450; 123/447

[58] Field of Search ..... 123/447, 506, 450, 458; 417/462

[56] References Cited

U.S. PATENT DOCUMENTS

| | | | |
|---|---|---|---|
| 4,889,096 | 12/1989 | Brunnel | 123/450 |
| 4,896,645 | 1/1990 | Potter | 123/506 |
| 4,920,940 | 5/1990 | Harris et al. | 123/450 |
| 4,940,036 | 7/1990 | Duplat | 123/506 |
| 4,971,012 | 11/1990 | Brunnel et al. | 123/506 |

*Primary Examiner*—Andrew M. Dolinar
*Assistant Examiner*—M. Macy
*Attorney, Agent, or Firm*—Dvorak and Traub

[57] ABSTRACT

A rotary distributor type of fuel pumping apparatus has a distributor member 10 mounting cam actuated pumping plungers 14. During inward movement of the plungers an electromagnetically operable valve 32 is operated which when open allows fuel under pressure to open a spill valve 31. The spill valve includes a spring loaded piston 23 which has a projection 22 engageable with a seating to prevent escape of fuel from the pumping chamber. Fuel under pressure is allowed to act on the piston when the valve is opened. The piston is pressure balanced by a plug 27 which is slidable in a drilling 25 in the piston, the drilling being connected by a passage 26 to the pumping chamber. The plug is held against movement and its diameter is substantially equal to the seat area to achieve pressure balance.

8 Claims, 1 Drawing Sheet

FUEL PUMPING APPARATUS

This invention relates to a fuel pumping apparatus for supplying fuel to an internal combustion engine and of the kind comprising a rotary distributor member housed within a body and arranged in use to be driven in timed relationship with an associated engine, a bore in the distributor member and a pumping plunger therein, a cam for imparting inward movement to the plunger to displace fuel from the bore, a delivery passage communicating with the bore and positioned to register in turn with a plurality of outlet ports in the body during successive inward movements of the plunger, means for filling the bore with fuel to effect outward movement of the plunger and spill means operable to spill fuel from said bore.

The object of the present invention is to provide such an apparatus in a simple and convenient form.

According to the invention in an apparatus of the kind specified said spill means comprises a cylinder defined in a part of the distributor member, a piston slidable in said cylinder, a port formed in an end wall of the cylinder and communicating with said bore, a seating defined about said port, a projection formed on the end face of the piston presented to said end wall, said projection being shaped for co-operation with said seating, resilient means biasing said piston so that the projection engages with said seating to prevent fuel flow through said port into an annular space defined about the projection and between said end face of the piston and said end wall of the cylinder, a drilling extending axially into said piston towards said end face, a passage extending through the projection from said drilling whereby the inner end of said drilling is in communication with said bore, a plug slidable in said drilling, said plug being located against axial movement, the end area of said plug being substantially equal to the area of said seat and means operable during the inward movement of the plunger to impart axial movement to the piston against the action of the resilient means thereby to lift the projection from the seating to allow further fuel displaced by the plunger to flow into said annular space.

An example of a fuel pumping apparatus in accordance with the invention will now be described with reference to the accompanying drawings in which.

Figure 1:
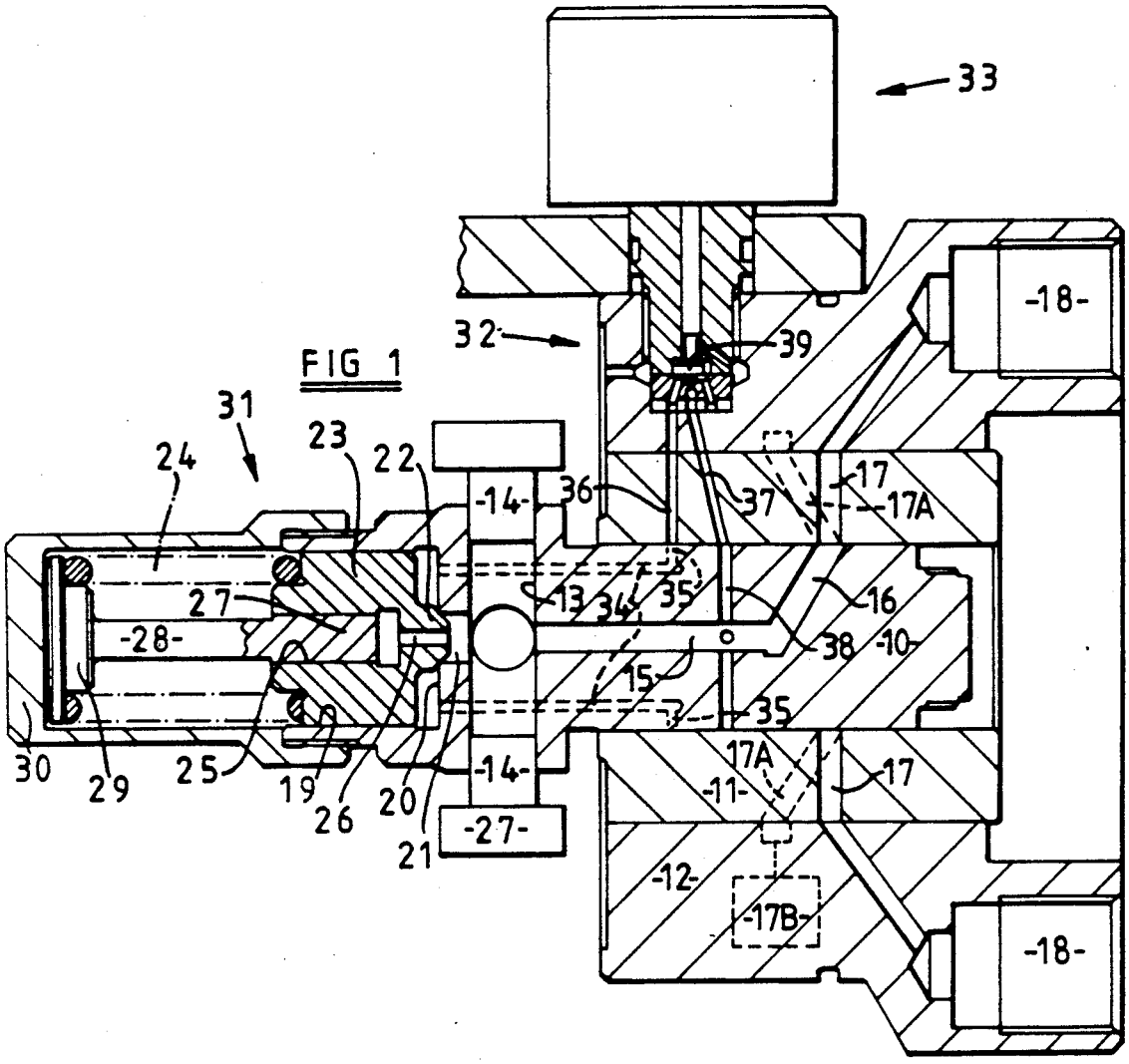
FIG. 1 is a part sectional side elevation of a portion of the apparatus.

Referring to FIG. 1 of the drawings the apparatus comprises a rotary distributor member 10 which is journaled in a fixed sleeve 11 forming part of a body 12. The distributor member in use, is driven in timed relationship with the associated engine. A portion of the distributor member extends from the sleeve and there is formed therein a transverse bore 13 in which is mounted a pair of pumping plungers 14. In the particular example, which shows a pump for supplying fuel to a four cylinder engine, a further transverse bore is provided and a further pair of plungers are located therein The bores are disposed at right angles to each other and the inner portions of the bores communicate with a longitudinal passage 15 extending within the distributor member and communicating with an outwardly extending delivery passage 16.

The plungers 14 are arranged to be moved inwardly by the action of cam lobes formed on the internal peripheral surface of a cam ring 17 which surrounds the distributor member and during the inward movement of the plungers 14, the delivery passage 16 registers with one of a plurality of outlet ports 17 which communicate with outlets 18 in the body, the outlets 18 in use being connected to the injection nozzles of the associated engine.

Alternately arranged with the outlet ports 17 are inlet ports 17A which communicate with a source of fuel under pressure, conveniently the outlet of a vane pump 17B the rotary part of which is coupled to the distributor member. In use, during the whole time the plungers are moved inwardly, the delivery passage 16 is in register with an outlet port 17 and fuel can be supplied to the associated engine. As the distributor member rotates, the delivery passage 16 moves out of register with an outlet port 17 and into register with an inlet port so that fuel can now flow to the bores 13 to urge the plungers outwardly by an amount which is determined by the base circle of the cam ring or by stop plates not shown, it being appreciated that normally cam followers including rollers, will be interposed between the plungers 14 and the cam lobes. Instead of using the delivery passage to fill the bores with fuel, separate inlet passages may be provided in the distributor member in which case the inlet ports will not be in the same radial plane as the outlet ports.

Formed in the distributor member is a cylinder 19 having an end wall 20 in which is formed a port 21 which communicates with the bores 13. Surrounding the port is a seating which is engaged by a shaped projection 22 extending from an end face of a piston 23 which is slidable within the cylinder. The piston is biased so that the projection engages with the seating, by means of a coiled compression spring 24. Formed in the piston is an axially disposed blind drilling 25 which extends towards said end face of the piston and the inner end of the drilling communicates by way of a passage 26 formed in the projection 22, with the bores 13. Slidable within the drilling 25 is a plug 27 which is carried on a stem 28 having an end portion 29 formed as a spring abutment. The spring 24 engages the abutment 29 and maintains the abutment in contact with the end wall 30 of a cap 31 which is in screw thread engagement with the extended portion of the distributor member.

The end area of the plug 27 is substantially equal to the area of contact between the seating and the projection 22 so that the piston is substantially pressure balanced and will be maintained in the position shown in which the extension is in engagement with the seating, by the force exerted by the spring 24. In order in use, to effect movement of the piston 23 against the action of the spring and thereby to lift the projection 22 from the seating so as to permit further fuel displaced by the plungers to flow into the annular space surrounding the extension, fuel under pressure is admitted to the aforesaid annular space so that the pressure acting on the end face of the piston which in part defines the annular space, will move the piston against the action of the spring. The flow of fuel into the annular space is conveniently controlled by a control valve generally indicated at 32 and which itself is controlled by an electromagnetic actuator 33. Supply of electric current to the actuator is under the control of an electronic control system not shown.

Extending from the aforesaid annular space are in the particular example, four axially disposed passages 34 which have radially disposed portions 35 opening onto the periphery of the distributor member at a position so that they can register with a first connecting port 36 formed in the body and sleeve. Also formed in the body and sleeve is a second connecting port 37 which extends from the periphery of the distributor member and the two connecting ports can be placed in communication with each other by the valve 32. The connecting port 37 is positioned to register with passages 38 formed in the distributor member and communicating with the longitudinal passage 15. Within the valve 32, the connecting port 37 is closed by a valve member 39 when the actuator is energised and the pressure of fuel within the connecting port 37 lifts the valve member 39 from its seating to permit flow of fuel into the connecting port 36 and through one of the passages 34 into the annular space when the actuator is de-energised. As previously stated the flow of electric current to the actuator 33 is controlled by an electronic control system and the actuator is arranged to be de-energised when a predetermined inward movement of the pumping plungers has taken place. When the actuator is de-energised fuel at high pressure is supplied to the annular space and this acts upon the end face of the piston to move the piston against the action of the spring 24. The initial movement lifts the projection 22 from the seating and substantially unrestricted flow of fuel can then take place into the annular space by way of the port 21. This flow of fuel results in a rapid reduction in the pressure of fuel and a rapid termination of the flow of fuel to the associated engine.

When the crests of the cam lobes are reached the plungers are allowed to move outwardly and the spring 24 urges the piston towards the position in which it is shown. This movement results in displacement of the fuel spilled into the aforesaid space back into the bores 13 to effect outward movement of the plungers. Such fuel as is lost by leakage together with the fuel delivered to the associated engine, is made up by a flow of fuel from the fuel supply pump by way of an inlet port and the passage 16. In order to ensure that the movement of the piston 23 under the action of the spring 24 is not hindered as the projection approaches the seating, a leakage path may be provided from the annular space. The leakage path is provided by a restricted drilling or it can be formed by ensuring that leakage of fuel can take place along the working clearance defined between the piston and the cylinder in which it is located. In the example the ports 36 and 37 are isolated from the passages 35 and 38 except during the inward movement of the plungers. However, if desired the connections need not be ported so that by maintaining the valve 32 in the open position whilst the piston 23 is returning to the position shown, there will be no need for the aforesaid restricted passage or clearance.

The cam ring 17 will be movable angularly to determine the timing of delivery of fuel to the associated engine and since delivery of fuel to the engine will take place as soon as inward movement of the plungers occurs, it is necessary for the control system to be aware of the precise angular position of the cam ring so that the control system can de-energise the actuator at the correct instant.

Figure 2:
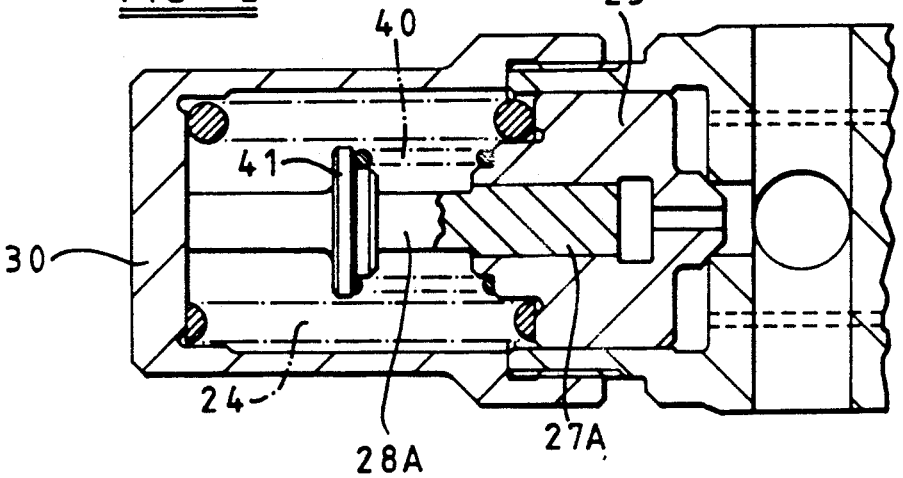
FIG. 2 shows a modification to the apparatus seen in FIG. 1.

FIG. 2 shows a modification in that the spring 24 bears directly against the end wall 30 of the cap. In addition, the stem 28A of the plug 27A engages the end wall 30 and is biased into contact therewith by means of a light spring 40 interposed between the piston 23 and a spring abutment 41 formed on the stem. This construction has the advantage that there is a reduced frictional contact between the stem 28A and the end wall 30 so that the plug and piston together can centralise more readily on the seating of the projection 22.

I claim:

1. A fuel pumping apparatus for supplying fuel to an internal combustion engine comprising a rotary distributor member housed within a body, a bore in the distributor member and a plunger therein, a cam for imparting inward movement to the plunger to displace fuel from the bore, a delivery passage communicating with the bore and positioned to register in turn with a plurality of outlet ports in the body during successive inward movement of the plunger, means for filling the bore with fuel to effect outward movement of the plunger and spill means operable to spill fuel from the bore characterised in that said spill means comprises a cylinder defined in a part of the distributor member, a piston slidable in the cylinder, a port formed in the end wall of the cylinder and communicating with the bore, a seating defined about said port, a projection formed on the end face of the piston presented to said end wall, said projection being shaped for co-operation with said seating, resilient means biasing said piston so that the projection engages with the seating to prevent fuel flow through said port into an annular space defined about the projection and between said piston and said end wall, a drilling extending axially into said piston towards said end face, a passage connecting the inner end of said drilling with said bore, a plug slidable in said drilling but located against axial movement, the end area of the plug being substantially equal to the area of the seat, and means operable during the inward movement of the plunger to impart axial movement to the piston against the action of the resilient means thereby to lift the projection from the seating to allow further fuel displaced by the plunger to flow into said annular space.

2. An apparatus according to claim 1, characterised in that said plug is connected by a stem to a spring abutment, a spring interposed between the spring abutment and the piston and a cap secured to the distributor member and defining an end wall engaged by said spring abutment.

3. An apparatus according to claim 1, characterised in that said resilient means comprises a first coiled compression spring acting intermediate said piston and the end wall of a cap secured to the distributor member and a second coiled compression spring acting between said piston and an abutment on a stem of said plug, said second spring being lighter than the first spring and acting to bias said stem into engagement with said end wall.

4. An apparatus according to claim 2, characterised in that the means operable to impart axial movement to the piston comprises an electromagnetically controlled valve which when opened admits fuel under pressure into said annular space from the bore.

5. An apparatus according to claim 4, characterised in that said valve is connected in a flow path including passages in the distributor member and further passages in the body, the passages being brought into registration to establish the flow path only during the inward movement of the plunger.

6. An apparatus according to claim 5 characterised by a restricted leakage path from said annular space.

7. An apparatus according to claim 4, characterised in that said valve is connected in a flow path which provides permanent communication between said bore and said annular space.

8. An apparatus according to claim 3, characterized in that the means operable to impart axial movement to the piston comprises an electromagnetically controlled valve which when opened admits fuel under pressure into said annular space from the bore.

* * * * *